US008430684B1

(12) United States Patent
Glatts, III

(10) Patent No.: US 8,430,684 B1
(45) Date of Patent: Apr. 30, 2013

(54) RIBBON CABLE CONNECTOR

(76) Inventor: George F. Glatts, III, Warminster, PA (US)

( * ) Notice: Subject to any disclaimer, the term of this patent is extended or adjusted under 35 U.S.C. 154(b) by 0 days.

(21) Appl. No.: 13/198,685

(22) Filed: Aug. 4, 2011

(51) Int. Cl.
*H01R 12/24* (2006.01)

(52) U.S. Cl.
USPC ..... 439/493

(58) Field of Classification Search ..... 439/329, 439/67, 77, 492–499
See application file for complete search history.

(56) References Cited

U.S. PATENT DOCUMENTS

| | | | | |
|---|---|---|---|---|
| 4,647,125 | A * | 3/1987 | Landi et al. | 439/67 |
| 5,156,553 | A * | 10/1992 | Katsumata et al. | 439/62 |
| 5,160,278 | A * | 11/1992 | Johnson | 439/593 |
| 5,171,154 | A * | 12/1992 | Casciotti et al. | 439/67 |
| 5,219,293 | A * | 6/1993 | Imamura | 439/67 |
| 5,297,968 | A * | 3/1994 | Johnson et al. | 439/67 |
| 5,378,161 | A * | 1/1995 | Loder | 439/77 |
| 5,385,478 | A * | 1/1995 | Niekawa | 439/67 |
| 5,462,441 | A * | 10/1995 | Renn et al. | 439/67 |
| 5,564,931 | A * | 10/1996 | Fabian et al. | 439/62 |
| 6,071,137 | A * | 6/2000 | Rutigliano | 439/197 |
| 6,238,237 | B1 * | 5/2001 | Nagahata et al. | 439/493 |
| 6,247,951 | B1 * | 6/2001 | Di Liello et al. | 439/329 |
| 6,273,747 | B1 | 8/2001 | Helfrich | |
| 6,453,550 | B1 * | 9/2002 | Farnworth et al. | 29/842 |
| 6,514,089 | B2 * | 2/2003 | Satou | 439/67 |
| 7,025,613 | B2 * | 4/2006 | Satou | 439/260 |
| 7,063,561 | B2 * | 6/2006 | Pabst | 439/498 |
| 7,101,220 | B2 * | 9/2006 | Satou | 439/492 |
| 7,172,455 | B2 * | 2/2007 | Pabst et al. | 439/496 |
| 7,367,845 | B2 * | 5/2008 | Farnworth et al. | 439/632 |
| 7,722,387 | B2 * | 5/2010 | Yamaji et al. | 439/497 |
| 7,914,321 | B2 * | 3/2011 | Huang | 439/495 |
| 8,083,551 | B2 * | 12/2011 | Hetzer et al. | 439/676 |
| 2006/0148308 | A1 * | 7/2006 | Pabst et al. | 439/495 |

* cited by examiner

*Primary Examiner* — Ross Gushi
(74) *Attorney, Agent, or Firm* — LaMorte & Associates, P.C.

(57) ABSTRACT

A connector assembly for connecting a ribbon cable to a circuit board mount. The circuit board mount has a base that is mounted to a circuit board. A dielectric support is secured to the base. The dielectric support has a convex protrusion. The dielectric support forms part of a ribbon cable receptacle, wherein the convex protrusion faces the ribbon cable receptacle. Conductive elements are arranged in parallel on the dielectric support. The conductive elements extend over the convex protrusion. The end of a ribbon cable is placed in the ribbon cable receptacle so that the traces on the ribbon cable contact the conductive elements. A clip or similar mechanical fastener is then used to bias the dielectric support against the ribbon cable so that the ribbon cable becomes pinched within the receptacle. In the receptacle, the conductive elements contact the ribbon cable at a tangent.

12 Claims, 8 Drawing Sheets

RIBBON CABLE CONNECTOR

BACKGROUND OF THE INVENTION

1. Field of the Invention

In general, the present invention relates to connectors that are used to terminate electrical ribbon cables. More particularly, the present invention relates to the structure of ribbon cable connectors and the manner in which such connectors create electrical contact with ribbon cables.

2. Prior Art Description

Ribbon connectors are used in many electronic devices, such as computers, scanners, printers and the like. Ribbon cables are cables where all the wires of the cable are aligned in parallel in a flat ribbon. Ribbon cables typically contain wires between 22 AWG and 26 AWG. A ribbon cable can contain up to eighty individual wires. However, most common ribbon cables contain between twelve and thirty individual wires.

Since a ribbon cable contains so many small individual wires, it is difficult to terminate ribbon cables correctly. If just one wire within the ribbon cable is not contacted properly within a connector, then the ribbon cable installation fails. Obviously, the difficultly in terminating ribbon cables is directly proportional to the gauge of the wires and the number of wires in the ribbon cables. In modern electronics, the wires are becoming increasingly thin. Likewise, the number of wires being used in ribbon cables is increasing. Accordingly, the difficulties of terminating ribbon cables is currently increasing.

Another problem associated with terminating ribbon cables is one of wire/contact misalignment. When a ribbon cable is terminated within a ribbon connector, each of the wires of the ribbon cable is brought into contact with some form of electrical contact. As wires become smaller and denser, so do the corresponding contacts within the connector. The density of the wires and contacts requires that a ribbon cable be precisely aligned within a connector. If the ribbon cable moves and becomes slightly askew, a wire from the ribbon cable may touch the wrong contact within the connector. The result is an electrical short.

In the prior art, the problems of creating a quality connection between a connector and a ribbon cable have been attempted in many ways. In many prior art connectors, pins are used to pierce the ribbon cable and contact the various wires. Such connectors are commonly referred to as insulation displacement connectors (IDC Connectors) such as the BT224 connector, as defined by BS9525-F0023, DIN41651, MIL-C-83503 standards.

Connectors that require that ribbon cables be pierced are very difficult to use with wide, high-density ribbon cables. As such, other approaches have been tried. One approach is to provide two off-set contacts for each wire within the connector. In this manner, the wires in a ribbon cable will only contact both of its contacts if that wire is properly aligned. Such prior art ribbon cable connectors are exemplified by U.S. Pat. No. 6,273,747 to Helfrich, entitled Connector For A Flat Flexible Cable.

The problem associated with such prior art connectors is that the connector merely provides a way to check if a ribbon cable is properly oriented. The connector does nothing to reduce the need for the ribbon cable to be properly oriented. As such, the same connections problems exist, those problems are only now more detectable.

A need therefore exists for a ribbon cable connector that is capable of creating a consistent, quality connection with a ribbon cable while simultaniously reducing the precision needed in placing the ribbon cable into the connector. These needs are met by the present invention as described and claimed below.

SUMMARY OF THE INVENTION

The present invention is a connector assembly for connecting at least one ribbon cable to a circuit board mount. The circuit board mount has a base that is mounted in a fixed position to a circuit board or similar substrate.

A dielectric support is provided that is secured to the base. The dielectric support has a first end, a second end, and a first convex protrusion that extends between the first end and the second end. The dielectric support forms at least part of a first ribbon cable receptacle, wherein the first convex protrusion faces the first ribbon cable receptacle.

A plurality of conductive elements are arranged in parallel on the dielectric support. The plurality of conductive elements lay perpendicular to the first line of progression and extend over the first convex protrusion.

The end of a ribbon cable is placed in the ribbon cable receptacle so that the traces on the ribbon cable contact the conductive elements exposed in the receptacle. A clip or similar mechanical fastener is then used to bias the dielectric support against the ribbon cable so that the ribbon cable becomes pinched within the receptacle. In the receptacle, the conductive elements contact the ribbon cable at a tangent. This contact configuration enables the ribbon cable to move slightly without shorting or disconnecting. Accordingly, a more robust connector is created.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

The present invention ribbon connector can be used to terminate ribbon cables of various widths and wire gauges. The ribbon cables shown in the illustrations should be considered generic, in that they represent any known ribbon cable. Three exemplary embodiments of the present invention ribbon connector are shown. The first embodiment is for use with a ribbon cable that has contact traces that face downwardly. The second embodiment is for use with a ribbon cable that has contact traces that face upwardly. The third embodiment shows a ribbon connector that is used to join two ribbon cables together. These embodiments were selected in order to set forth some of the best modes contemplated for the invention. The illustrated embodiments, however, are merely exemplary and should not be considered a limitation when interpreting the scope of the appended claims.

Figure 1:
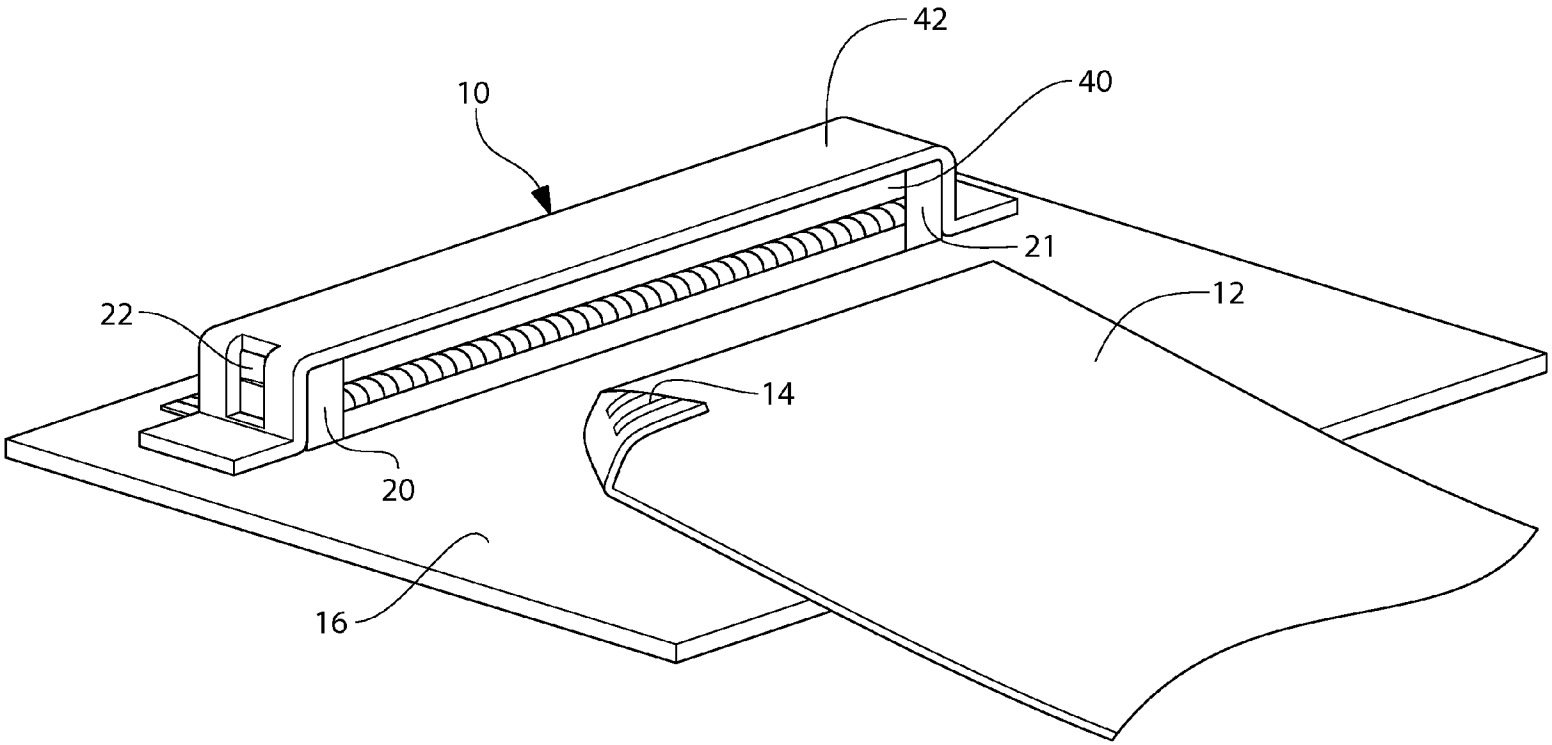
FIG. 1 is a perspective view of a first exemplary embodiment of a connector engaging a ribbon cable.
Figure 2:
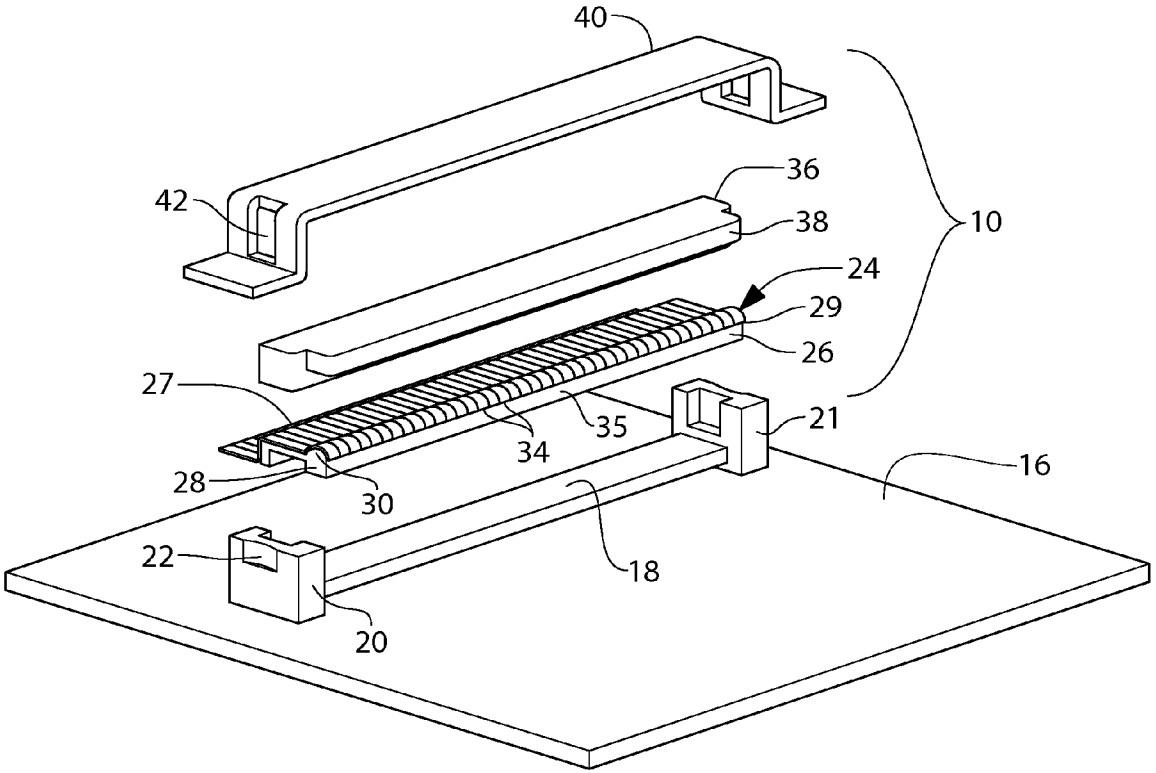
FIG. 2 is an exploded view of the embodiment of FIG. 1.
Figure 3:
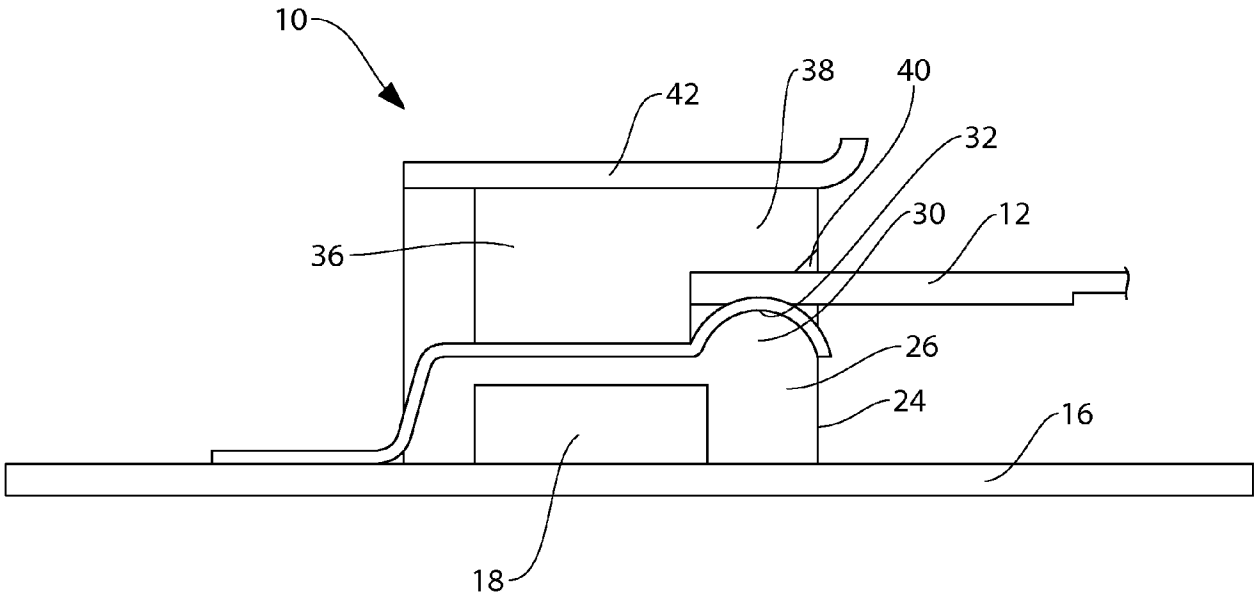
FIG. 3 is a cross-sectional view of the embodiment of FIG. 1.

Referring to FIG. 1 in conjunction with both FIG. 2 and FIG. 3, a first embodiment of a ribbon connector 10 is shown. The ribbon connector 10 is designed to interconnect a ribbon cable 12 with downwardly facing contact traces 14 to the circuitry on a printed circuit board 16 or similar substrate.

The ribbon cable 12 is a traditional ribbon cable that contains a plurality of parallel wires. Each wire within the ribbon cable 12 terminates with a contact trace 14, as is well practiced in the art.

The ribbon connector 10 has a clip base 18 that is mounted to the printed circuit board 16 using traditional mounting techniques. As such, the clip base 18 is set in a fixed position on the printed circuit board 16 and cannot be moved. The clip base 18 contains two vertical mounts 20, 21 that are set a predetermined distance apart. Each of the vertical mounts 20, 21 includes a locking finger projection 22.

A contact plate 24 is placed atop the clip base 18 between the two vertical mounts 20, 21. The contact plate 24 includes a dielectric support 26. The dielectric support 26 is made from plastic, ceramic, or some other dielectric material. The dielectric support 26 has a top surface 27 that runs between two parallel side edges 28, 29. A convex protrusion 30 extends across the top surface 27 between the two parallel side edges 28, 29. The convex protrusion 30 has an apex 32 that is the highest point along the dielectric support 26.

Conductive elements 34 are mounted to the top surface 27 of the dielectric support 26. The conductive elements 34 are equal in number to the number of wires contained within the ribbon cable 12. The conductive elements 34 all run in parallel. Each of the conductive elements 34 begins at the forward edge 35 of the dielectric support 26 and runs rearwardly off the dielectric support 20 and onto the printed circuit board 16. The various conductive elements 34 are either then soldered or otherwise mounted to the printed circuit board 16. Accordingly, each of the conductive elements 34 extends over the apex 32 of the convex protrusion 30, even though the conductive elements 34 are perpendicular to the run of the convex protrusion 30.

The conductive elements 34 can be thin strips of conductive film or electroplated strips applied to the dielectric support 26. However, in the preferred embodiment, each conductive element 34 is comprised of one or more micro-wires that are mounted to the surface of the dielectric support 26.

A bias plate 36 is placed atop the contact plate 24 in between the vertical mounts 20, 21. The bias plate 36 is dielectric. The bias plate 36 has a protruding ledge 38. When the bias plate 36 is placed atop the contact plate 24, the protruding ledge 38 is suspended as a cantilever over the convex protrusion 30. The ledge 38 does not contact the convex protrusion 30 or the conductive elements 34. Rather, the ledge 38 combines with the underlying contact plate 24 to define a ribbon cable receptacle 40. The ribbon cable receptacle 40 has a length that is slightly longer than the width of the ribbon cable 12. Furthermore, the distance D1 between the apex 32 of the convex protrusion 30 and the ledge 38 is slightly smaller than the thickness of the ribbon cable 12.

A clip head 42 is provided. The clip head 42 extends over the bias plate 36 and the vertical mounts 20, 21. The clip head 42 has openings 43 that engage the locking finger projections 22 on the vertical mounts 20, 21 and mechanically interconnect the clip head 42 to the clip base 18. Accordingly, the clip base 18 and the clip head 42 combine to create a mechanical fastener that secures the dielectric support 26 and the contact plate 24 to the circuit board 16. Once the clip head 42 is locked in place, it presses the bias plate 36 against the contact plate 24, therein preventing these components from moving independently.

To engage the ribbon cable 12 with the ribbon connector 10, the clip head 42 is removed. The ribbon cable 12 is then placed in the ribbon cable receptacle 40 so that the conductive traces 14 lay against the conductive elements 34. Without the clip head 42 in place, the bias plate 36 is free to rise up to make room for the ribbon cable 12 within the ribbon cable receptacle 40. The presence of the vertical mounts 20, 21 guides the ribbon cable 12 into place and only allows for a side-to-side movement of the ribbon cable 12 of less than ten degrees.

Once the ribbon cable 12 is inserted into the ribbon cable receptacle 40, the clip head 42 is locked in place. This presses the bias plate 36 down and causes the conductive traces 14 of the ribbon cable 12 to be pinched between the ledge 38 of the bias plate 36 and the conductive elements 34 at the apex 32 of the convex protrusion 30.

Figure 4:
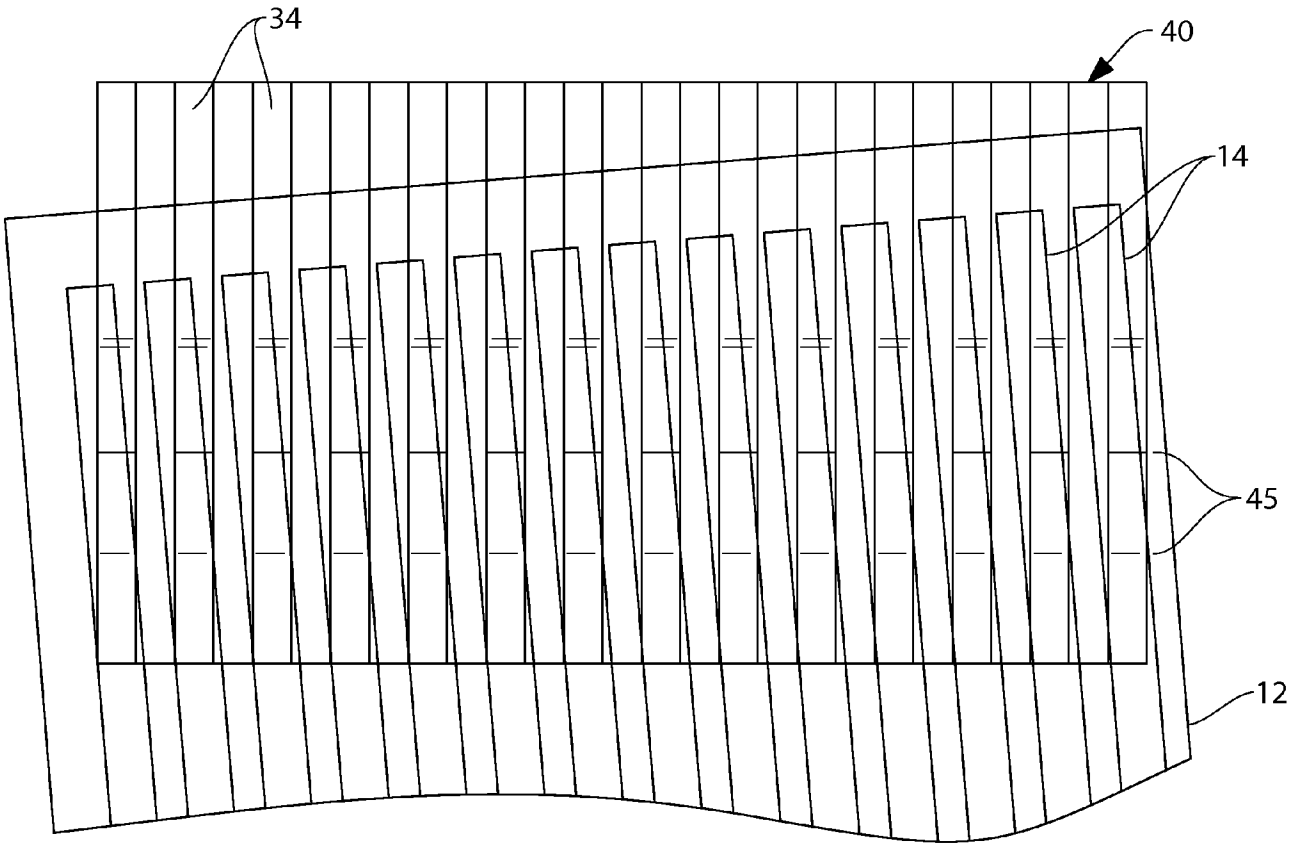
FIG. 4 is a perspective view of a second exemplary embodiment of a connector engaging a ribbon cable.

The conductive traces 14 touch the conductive elements 34 only at the apex 32 of the convex protrusion 30. This contact is a tangential contact. Referring now to FIG. 4 in conjunction with FIG. 3, it will be understood that if the ribbon cable 12 were to wiggle or move out of proper alignment within the ribbon cable receptacle 40, as is shown in FIG. 4, the tangential contact can be maintained throughout a contact area 45. Even if the ribbon cable 12 were to shift and the traces 14 pass over adjacent contact elements 34, there is no electrical short. Rather, proper contact is maintained in the contact area 45. Consequently, the ribbon cable 12 does not have to be precisely aligned with the cable ribbon receptacle 40. Rather, the general alignment provided by the vertical mounts 20, 21 (FIG. 2) on the sides of the ribbon cable receptacle 40 are sufficient to orient the ribbon cable 12 properly.

The result is a highly reliable connection. The ribbon cable 12 can be placed in the ribbon cable receptacle 40 without great care. The guidance provided by the shape of the ribbon cable receptacle 40 is sufficient enough to properly orient the ribbon cable 12. The electrical interconnection between the ribbon cable 12 and the ribbon connector 10 can be maintained even if the ribbon cable 12 is inadvertently pulled or is caused to slightly move. Provided the end of the ribbon cable 12 remains in the ribbon cable receptacle 40, a proper electrical interconnection can be maintained.

In the exemplary embodiment of FIGS. 1-4, it was assumed that the ribbon cable 12 had contact traces 14 that faced downwardly when engaging the ribbon connector 10. The ribbon connector 10 can also be readily configured to accept ribbon cables that have upwardly facing contact traces 14. Such an alternate configuration can be described while referring to both FIG. 5 and FIG. 6.

Figure 5:
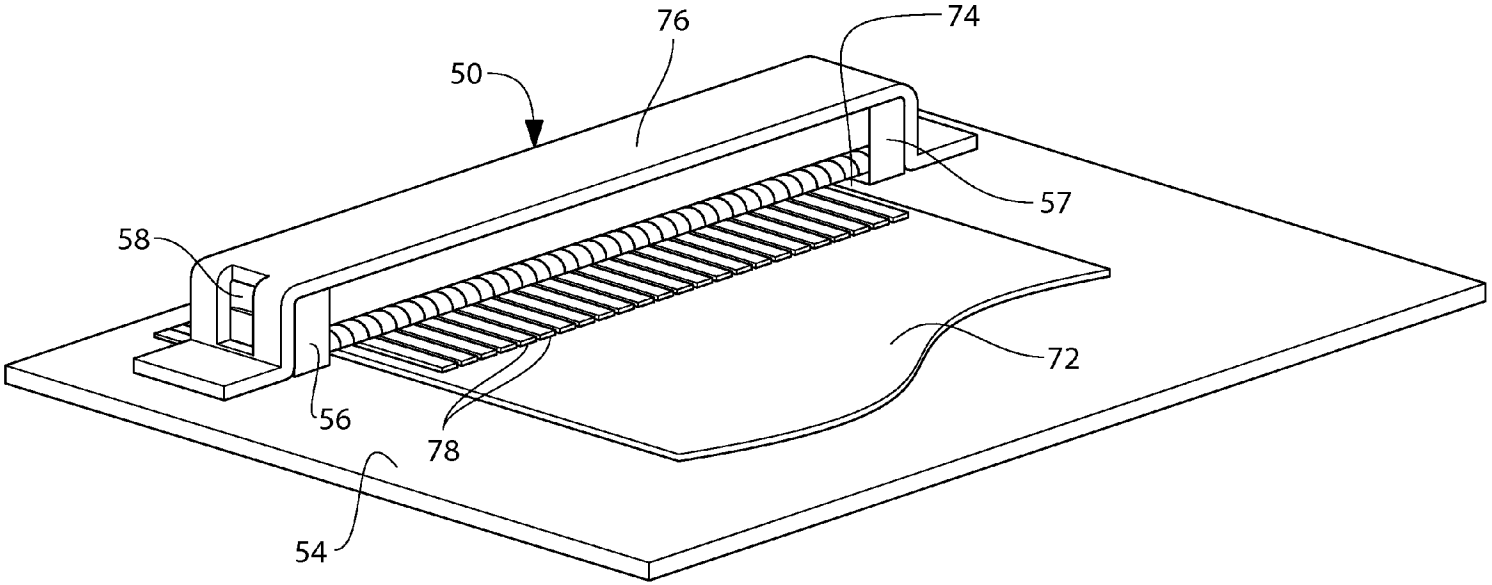
FIG. 5 is an exploded view of the embodiment of FIG. 4.
Figure 6:
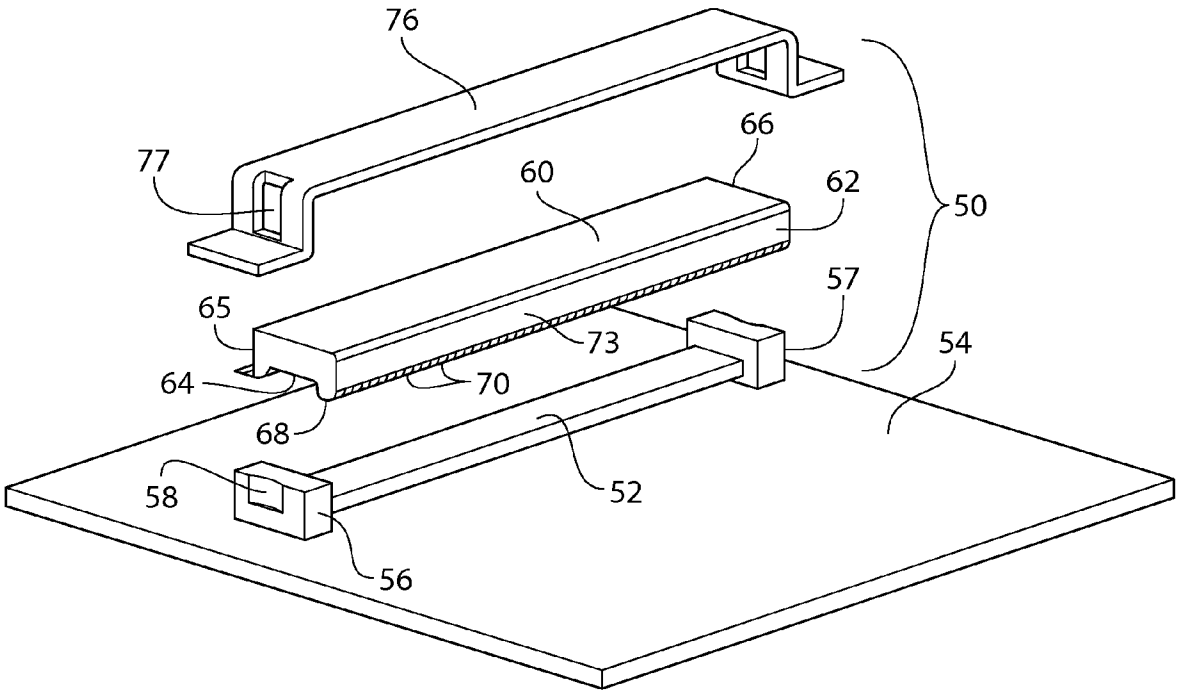
FIG. 6 is a cross-sectional view of the embodiment of FIG. 4.

In FIG. 5 and FIG. 6, a ribbon connector 50 is provided that has a clip base 52. The clip base 52 is mounted to the printed circuit board 54 using traditional mounting techniques. As such, the clip base 52 is set in a fixed position on the printed circuit board 16 and cannot be moved. The clip base 52 contains two vertical mounts 56, 57 that are set a predetermined distance apart. Each of the vertical mounts 56, 57 includes a locking finger projection 58.

A contact plate 60 is placed atop the clip base 52 between the vertical mounts 56, 57. The contact plate 60 includes a dielectric support 62. The dielectric support 62 is made from plastic, ceramic, or some other dielectric material. The dielectric support 62 has a bottom surface 64 that runs between two parallel side edges 65, 66. A convex protrusion 68 extends across the bottom surface 64 between the two parallel side edges 65, 66. The convex protrusion 68 has an inverted apex 69 that runs along its length.

Conductive elements 70 are mounted to the bottom surface 64 of the dielectric support 62. The conductive elements 70 are equal in number to the number of wires contained within the ribbon cable 72. The conductive elements 70 all run in parallel. Each of the conductive elements 70 begins at the forward edge 73 of the dielectric support 62 and runs rearwardly off the dielectric support 62 and onto the printed circuit board 54. The various conductive elements 70 are either then soldered or otherwise mounted to the printed circuit board 54. Accordingly, each of the conductive elements 70 extends under the inverted apex 69 of the convex protrusion 68, even though the conductive elements 70 are perpendicular to the run of the convex protrusion 68.

When the contact plate 60 is set in place, the inverted apex 69 of the convex protrusion 68 does not touch the circuit board 54. Rather the convex protrusion 68 and the conductive elements 70 on the convex protrusion 68 are suspended a short distance above the level of the circuit board 54. The contact plate 60 and the underlying circuit board 54, therefore, combine to create a ribbon cable receptacle 74. The ribbon cable receptacle 74 has a length that is slightly longer than the width of the ribbon cable 72. Furthermore, the distance between the inverted apex 69 of the convex protrusion 68 and the circuit board 54 is slightly smaller than the thickness of the ribbon cable 72.

A clip head 76 is provided. The clip head 76 extends over the top of the contact plate 60 and the vertical mounts 56, 57. The clip head 76 has openings 77 that engage the locking finger projections 58 on the vertical mounts 56, 57 and mechanically interconnect the clip head 76 to the clip base 52. Once the clip head 76 is locked in place, it presses the contact plate 60 against the circuit board 54.

In order to engage the ribbon connector 50 with the ribbon cable 72, the clip head 76 is removed. The ribbon cable 72 is then placed in the ribbon cable receptacle 74 so that the conductive traces 78 lay against the conductive elements 70. Without the clip head 76 in place, the contact plate 60 is free to rise up to make room for the ribbon cable 72 within the ribbon cable receptacle 74.

Once the ribbon cable 72 is inserted into the ribbon cable receptacle 74, the clip head 76 is locked in place. This presses the contact plate 60 down and causes the conductive traces 78 of the ribbon cable 72 to be pinched against the conductive elements 70 at the apex 69 of the convex protrusion 68.

The conductive traces 78 touch the conductive elements 70 only at the apex 69 of the convex protrusion 68. This contact is a tangential contact. This provides a reliable electrical interconnection for the reasons previously provided.

Figure 7:
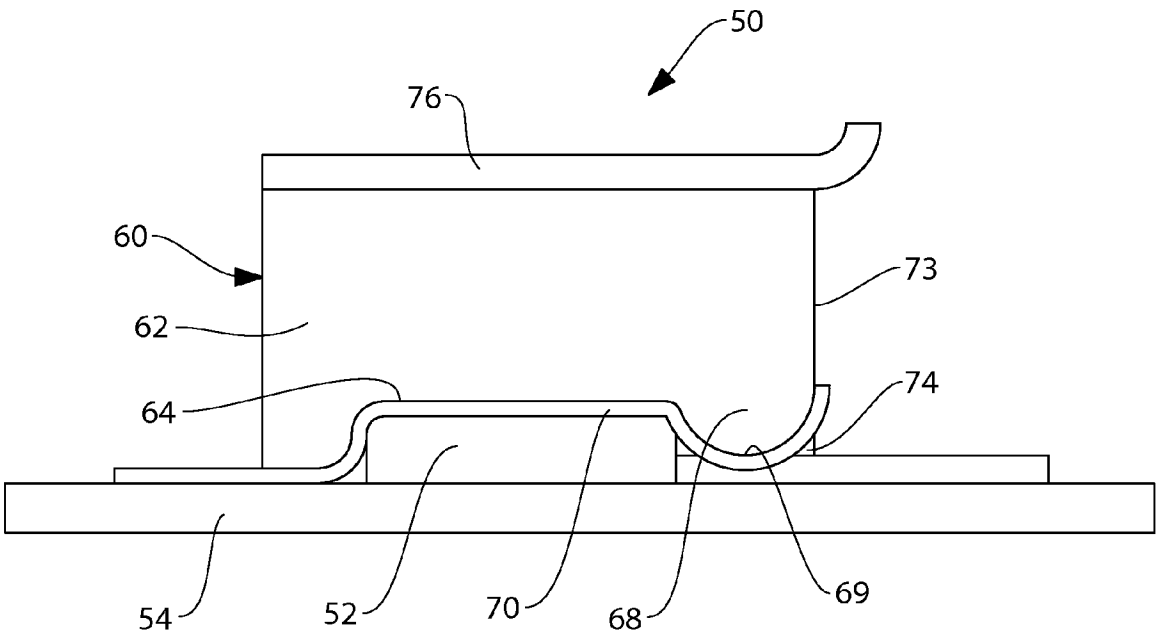
FIG. 7 is an exploded view of a third exemplary embodiment of a connector engaging two ribbon cables.
Figure 8:
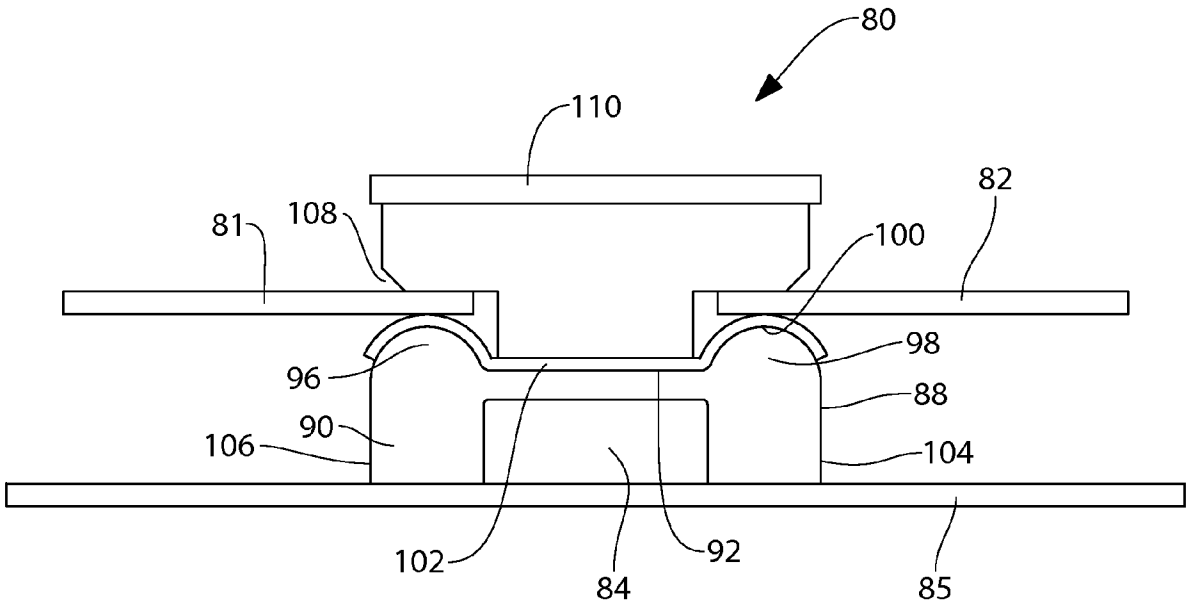
FIG. 8 is a cross-sectional view of the embodiment of FIG. 7.

There are some situations where a connector is used to join two ribbon cables together, rather than to join a ribbon cable to a circuit board. The present invention connector can be used for this purpose. Referring now to FIG. 7 in conjunction with FIG. 8, a connector 80 is disclosed that is used to interconnect two ribbon cables 81, 82. The connector 80 has a clip base 84. The clip base 84 is mounted to the printed circuit board 85 using traditional mounting techniques. As such, the clip base 84 is set in a fixed position on the printed circuit board 85 and cannot be moved. The clip base 84 contains two vertical mounts 86, 87 that are set a predetermined distance apart.

A contact plate 88 is placed atop the clip base 84 between the vertical mounts 86, 87. The contact plate 88 includes a dielectric support 90. The dielectric support 90 is made from plastic, ceramic or some other dielectric material. The dielectric support 90 has a bottom surface 92 that runs between two parallel side edges 94, 95. Two convex protrusions 96, 98 are provided that extend across the bottom surface 92. Each of the convex protrusions 96, 98 has an inverted apex 100 that runs along its length.

Conductive elements 102 are mounted to the bottom surface 92 of the dielectric support 90. The conductive elements 102 are equal in number to the number of wires contained within the ribbon cables 81, 82. The conductive elements 102 all run in parallel. Each of the conductive elements 102 begins at the forward edge 104 of the dielectric support and runs to the rearward edge 106. Accordingly, each of the conductive elements 102 extend under the inverted apexes 100 of both convex protrusions 96, 98.

A ribbon cable receptacle 108 is formed under each convex protrusion 96, 98. A clip head 110 is provided. The clip head 110 extends over the top of the contact plate 88 and the vertical mounts 86, 87. The clip head 110 engages the vertical mounts 86, 87 and mechanically interconnect the clip head 110 to the clip base 84. Once the clip head 110 is locked in place, it presses the contact plate 88 against the circuit board 85.

In order to engage the ribbon connector 80 with both ribbon cables 81, 82, the clip head 110 is removed. The ribbon cables 81, 82 are then placed into the two ribbon cable receptacles 108 so that the conductive traces 112 lay against the conductive elements 102. Without the clip head 110 in place, the contact plate 88 is free to rise up to make room for the ribbon cables 81, 82 within the ribbon cable receptacles 108.

Once the ribbon cables 81, 82 are inserted into the ribbon cable receptacle 108, the clip head 110 is locked in place. This presses the contact plate 88 down and causes the conductive traces 112 of the ribbon cables 81, 82 to be pinched against the conductive elements 102 on the apexes 100 of each convex protrusion 96, 98.

The conductive traces 112 touch the conductive elements 102 only at the apexes 100 of the convex protrusions 96, 98. These contacts are tangential contacts. This provides reliable electrical interconnections for the reasons previously provided.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A connector assembly for connecting a ribbon cable to a circuit board, said assembly comprising:

a base mounted to said circuit board;

a dielectric support secured to said base, said dielectric support having a first end and a second end, wherein said dielectric support has a first convex protrusion that extends between said first end and said second end along a first line of progression;

a bias plate disposed atop said dielectric support, wherein said bias plate and said dielectric support form at least part of a first ribbon cable receptacle, wherein said first convex protrusion faces said first ribbon cable receptacle;

a plurality of conductive elements arranged in parallel on said dielectric support, wherein said plurality of conductive elements lay perpendicular to said first line of progression and extends over said first convex protrusion; and a clip having two vertical mounts positioned a predetermined distance apart, wherein said dielectric support and said bias plate are disposed between said vertical mounts and said vertical mounts define opposing sides of said ribbon cable receptacle, wherein said clip biases said bias plate against said dielectric support.

2. The connector assembly according to claim 1, wherein said plurality of conductive elements lead away from said connector assembly and connect to said circuit board.

3. The connector assembly according to claim 1, wherein said clip includes a clip head that engages said base and selectively secures said dielectric support to said base.

4. The connector according to claim 1, wherein said apex of said first convex protrusion is oriented vertically upward within said first ribbon cable receptacle, away from said circuit board.

5. The connector assembly according to claim 1, wherein said apex of said first convex protrusion is oriented vertically downward within said first cable receptacle toward said circuit board.

6. The connector assembly according to claim 1, wherein said dielectric support has a second convex protrusion that runs parallel to said first convex protrusion, and wherein said dielectric support forms at least part of a second ribbon cable receptacle, wherein said second convex protrusion faces said first ribbon cable receptacle.

7. The connector assembly according to claim 6, wherein said plurality of conductive elements extends over said second convex protrusion.

8. A ribbon cable connector,
comprising:

a dielectric support having a top surface, and a convex protrusion that extends along said top surface, wherein said convex protrusion has an apex;

a plurality of conductive elements on said top surface of said dielectric support that extend over said apex of said convex protrusion;

a bias plate disposed atop said dielectric support, wherein said bias plate and said dielectric support define a ribbon cable receptacle and wherein said apex of said convex protrusion lay exposed within said ribbon cable receptacle;

a clip having a clip base and a removable clip head, wherein said clip base includes two vertical mounts positioned a predetermined distance apart, wherein said dielectric support and said bias plate are disposed between said vertical mounts and said vertical mounts define opposing sides of said ribbon cable receptacle, and wherein said clip biases said bias plate against said dielectric support.

9. The ribbon cable connector according to claim 8, wherein said clip joins said dielectric support and said bias plate to an underlying circuit board.

10. The ribbon cable connector according to claim 9, wherein said plurality of conductive elements lead away from said dielectric support and connect to said circuit board.

11. A ribbon cable connector for connecting a ribbon cable to a circuit board,
comprising:

a dielectric support having a bottom surface, and a convex protrusion that extends along said bottom surface, wherein said convex protrusion has an apex;

a plurality of conductive elements on said bottom surface of said dielectric support that extend over said apex of said convex protrusion, wherein said plurality of conductive elements lead away from said dielectric support and connect to said circuit board;

wherein said circuit board and said dielectric support define a ribbon cable receptacle and wherein said apex of said convex protrusion lay exposed within said ribbon cable receptacle;

a mechanical fastener for connecting said dielectric support to said circuit board.

12. The ribbon cable connector according to claim 11, wherein said mechanical fastener is a clip having a clip base and a removable clip head, wherein said clip base includes two vertical mounts positioned a predetermined distance apart, wherein said dielectric support is disposed between said vertical mounts and said vertical mounts define opposing sides of said ribbon cable receptacle.

* * * * *